US009644899B2

(12) United States Patent
Cowburn et al.

(10) Patent No.: US 9,644,899 B2
(45) Date of Patent: May 9, 2017

(54) HEATING ELEMENT UNDULATION PATTERNS

(75) Inventors: Lawrence G. Cowburn, Ulysses, PA (US); Scott R. Duffney, Little Gennessee, NY (US); Dennis R. Grantier, Wellsville, NY (US); Jeffery E. Yowell, Portville, NY (US)

(73) Assignee: Arvos, Inc., Wellsville, NY (US)

( * ) Notice: Subject to any disclaimer, the term of this patent is extended or adjusted under 35 U.S.C. 154(b) by 916 days.

(21) Appl. No.: 13/150,428

(22) Filed: Jun. 1, 2011

(65) Prior Publication Data

US 2012/0305217 A1 Dec. 6, 2012

(51) Int. Cl.

| | |
|---|---|
| ***F28D 17/00*** | (2006.01) |
| ***F23L 15/02*** | (2006.01) |
| ***F28D 19/00*** | (2006.01) |
| ***F28F 27/02*** | (2006.01) |
| ***F28F 3/00*** | (2006.01) |
| ***F28D 19/04*** | (2006.01) |
| *F28F 3/04* | (2006.01) |

(Continued)

(52) U.S. Cl.

CPC ..... *F28D 19/044* (2013.01); *F28D 19/041* (2013.01); *F28F 3/025* (2013.01); *F28F 3/046* (2013.01); *F28F 3/08* (2013.01); *F28F 3/083* (2013.01); *F28F 3/086* (2013.01)

(58) Field of Classification Search

CPC .. F28F 3/025; F28F 3/046; F28F 3/08–3/086; F28F 5/02; F28F 13/02; F28F 13/06; F28F 3/083; F28D 17/00; F28D 17/02; F28D 19/00; F28D 19/04–19/044; F28D 19/041; F28D 19/042; F28D 9/0025; F28D 9/0031; F28D 9/0037; F28D 9/0062; Y10S 165/016; Y10S 165/029; Y10S 165/042; Y10S 165/394; Y10S 165/399; Y10S 165/467

USPC .... 165/4, 6, 8, 9.2, 10, 109.1, 164–167, 186

See application file for complete search history.

(56) References Cited

U.S. PATENT DOCUMENTS

| | | | | |
|---|---|---|---|---|
| 2,313,081 A * | 3/1943 | Ljungstrom | ..... | F28D 19/042 165/9 |
| 2,596,642 A * | 5/1952 | Boestad | ..... | F28D 19/042 165/10 |
| 2,940,736 A | 6/1960 | Odman | | |

(Continued)

FOREIGN PATENT DOCUMENTS

| | | |
|---|---|---|
| CN | 101210780 B | 10/2010 |
| EP | 1 884 732 | 2/2008 |
| WO | 2012/000767 | 1/2012 |

*Primary Examiner* — Justin Jonaitis
*Assistant Examiner* — Paul Alvare
(74) *Attorney, Agent, or Firm* — MKG, LLC

(57) ABSTRACT

Heat transfer sheets (70) for a rotary regenerative heat exchanger (10) have a alternating first and second undulation surfaces (71,81). The first and second undulation surfaces (71,81) are composed of parallel ridges (75,85) angled in alternating directions. When the heat transfer sheets (70) are stacked, they create passageways (79) between them that direct air/gas through them. The ridges (75,85) redirect the air flow near the surface of the heat transfer sheet (70) imparting turbulence reducing laminar flow to improve heat transfer. The heat transfer sheets (80) employ curved ridges (95) having valleys (97) between them that define passageways (99) that constantly redirect the air/gas flow minimizing turbulence, creating efficient heat transfer.

13 Claims, 6 Drawing Sheets

(51) Int. Cl.
*F28F 3/08* (2006.01)
*F28F 3/02* (2006.01)

(56) References Cited

U.S. PATENT DOCUMENTS

| | | | | | |
|---|---|---|---|---|---|
| 3,373,798 | A | * | 3/1968 | Brummett | F28D 19/045 165/10 |
| 3,415,502 | A | * | 12/1968 | Munters | B01J 19/32 261/112.2 |
| 3,490,523 | A | * | 1/1970 | Esmond | 165/166 |
| 3,618,778 | A | * | 11/1971 | Benton | B01J 19/32 210/150 |
| 3,759,323 | A | * | 9/1973 | Dawson et al. | 165/166 |
| 3,963,810 | A | * | 6/1976 | Holmberg | B01J 19/32 261/112.2 |
| 4,125,149 | A | | 11/1978 | Kritzler et al. | |
| 4,396,058 | A | | 8/1983 | Kurschner et al. | |
| 4,553,458 | A | | 11/1985 | Schoonover | |
| 4,744,410 | A | | 5/1988 | Groves | |
| 5,333,482 | A | | 8/1994 | Dunlap et al. | |
| 5,544,703 | A | * | 8/1996 | Joel et al. | 165/167 |
| 5,836,379 | A | | 11/1998 | Counterman | |
| 6,019,160 | A | * | 2/2000 | Chen | 165/10 |
| 7,044,206 | B2 | * | 5/2006 | Sabin et al. | 165/166 |
| 7,117,928 | B2 | * | 10/2006 | Chen | 165/80.3 |
| 2010/0282437 | A1 | * | 11/2010 | Birmingham et al. | 165/67 |

* cited by examiner

HEATING ELEMENT UNDULATION PATTERNS

TECHNICAL FIELD

The devices described herein relate to heating elements or heat transfer sheets of the type found in rotary regenerative heat exchangers.

BACKGROUND

Regenerative air preheaters are used on large fossil fuel boilers to preheat the incoming combustion air from exiting hot exhaust gases. These recycle energy and conserve fuel. Recovering useful heat energy that would otherwise be lost to the atmosphere is an effective way to gain significant cost savings, conserve fossil fuels, and reduce emissions.

One type of regenerative heat exchanger, a rotary regenerative heat exchanger, is commonly used in fossil fuel boilers and steam generators. Rotary regenerative heat exchangers have a rotor mounted in a housing that defines a flue gas inlet duct and a flue gas outlet duct for the flow of heated flue gases through the heat exchanger. The housing further defines another set of inlet ducts and outlet ducts for the flow of gas streams that receive the recovered heat energy. The rotor has radial partitions or diaphragms defining compartments between the partitions for supporting baskets or frames to hold heating elements that are typically heat transfer sheets. Referring to FIG. 1, a rotary regenerative heat exchanger, generally designated by the reference number 10, has a rotor 12 mounted in a housing 14.

The heat transfer sheets are stacked in the baskets or frames. Typically, a plurality of sheets are stacked in each basket or frame. The sheets are closely stacked in spaced relationship within the basket or frame to define passageways between the sheets for the flow of gases. Examples of heat transfer element sheets are provided U.S. Pat. Nos. 2,596,642; 2,940,736; 4,363,222; 4,396,058; 4,744,410; 4,553,458; 6,019,160; and 5,836,379.

Pending U.S. patent application (WO5/006-0) Ser. No. 12/437,914 filed May 8, 2009 entitled "Heat Transfer Sheet For Rotary Regenerative Heat Exchanger", published Nov. 11, 2010 describes different designs for heat exchange sheets, hereby incorporated by reference as if set forth in its entirety herein.

Hot gases are directed through the rotary heat exchanger to transfer heat to the sheets. As the rotor rotates, the recovery gas stream (air side flow) is directed over the heated sheets, thereby causing the intake air to be heated. In many instances, the intake air is provided to the boiler for combustion of the fossil fuels. Hereinafter, the recovery gas stream shall be referred to as combustion air or input air. In other forms of rotary regenerative heat exchangers, the sheets are stationary and the flue gas and the recovery gas ducts are rotated.

Current designs of heat transfer sheets only recover a portion of the heat in the exhaust flue gases with the unrecovered heat passing out of the stack as waste energy. The more efficiently these heat transfer sheets operate, the less the wasted heat.

Currently, there is a need for more efficient heat exchange sheet designs.

SUMMARY OF THE INVENTION

The present invention may be embodied as a heat transfer sheet for a rotary regenerative heat exchanger that receives hot flue gas stream and an air stream and transfers heat from the hot flue gas stream to the air stream, the heat transfer sheet having:

a plurality of sheet spacing features extending along the heat transfer sheet substantially parallel to a direction of the hot flue gas stream, the sheet spacing features defining a portion of a flow passage between an adjacent heat transfer sheet; and a plurality of undulating surfaces disposed between each pair of adjacent sheet spacing features, the plurality of undulating surfaces including:

a first undulating surface formed by a plurality of elongated ridges extending along the heat transfer sheet parallel to each other at a first angle $A_1$ relative to the sheet spacing features, and a second undulating surface formed by a plurality of elongated ridges extending along the heat transfer sheet parallel to each other at a second angle $A_2$ relative to the sheet spacing features, the first angle $A_1$ being different from the second angle $A_2$.

The present invention may also be embodied as a heat transfer sheet comprising:

a plurality of ridges and valleys are shaped as at least a partial sinusoidal pattern, extending from a first end to a second end, oriented such that a fluid passing from the first end to the second end is at least partially redirected in an alternating manner between a first direction and a second direction.

The present invention may also be embodied as a basket for a rotary regenerative heat exchanger, the basket having:

a frame; and at least one heat transfer sheet with:

a plurality of ridges and valleys having at least a partial sinusoidal pattern, extending from a first end to a second end, oriented such that a fluid passing from the first end to the second end is at least partially redirected in an alternating manner from side to side.

BRIEF DESCRIPTION OF THE DRAWINGS

The subject matter described in the description of the preferred embodiments is particularly pointed out and distinctly claimed in the claims at the conclusion of the specification. The foregoing and other features and advantages are apparent from the following detailed description taken in conjunction with the accompanying drawings in which:

DESCRIPTION OF THE PREFERRED EMBODIMENTS

Figure 7:
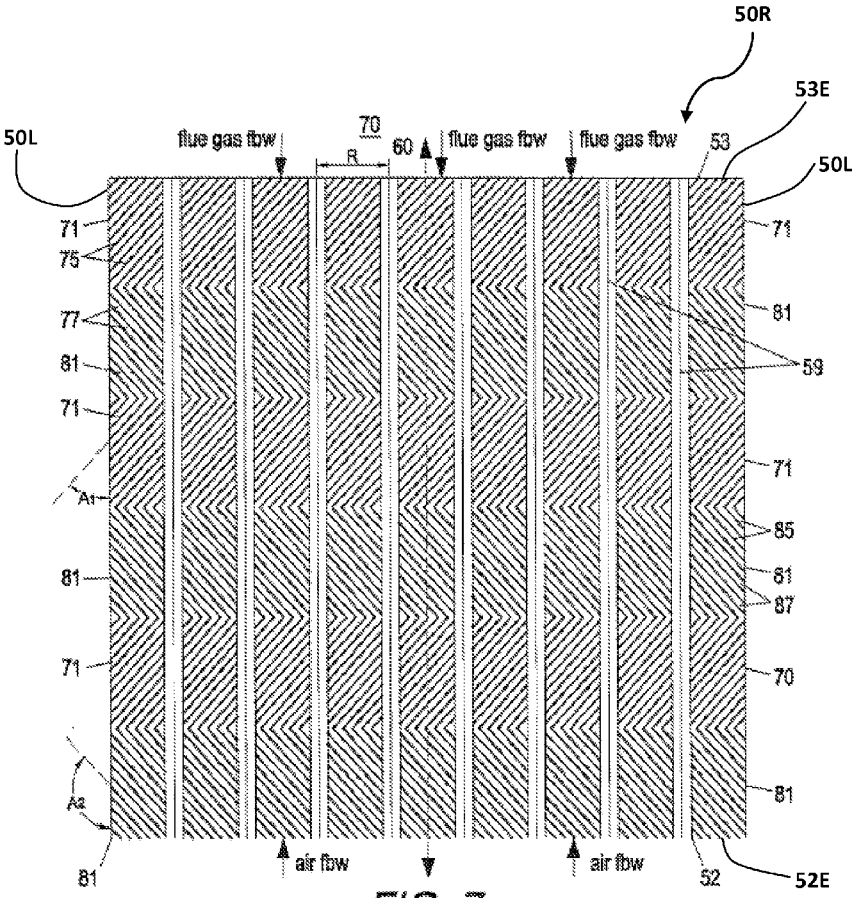
FIG. 7 is a plan view of a full heat transfer sheet having the pattern of FIG. 5.
Figure 8:
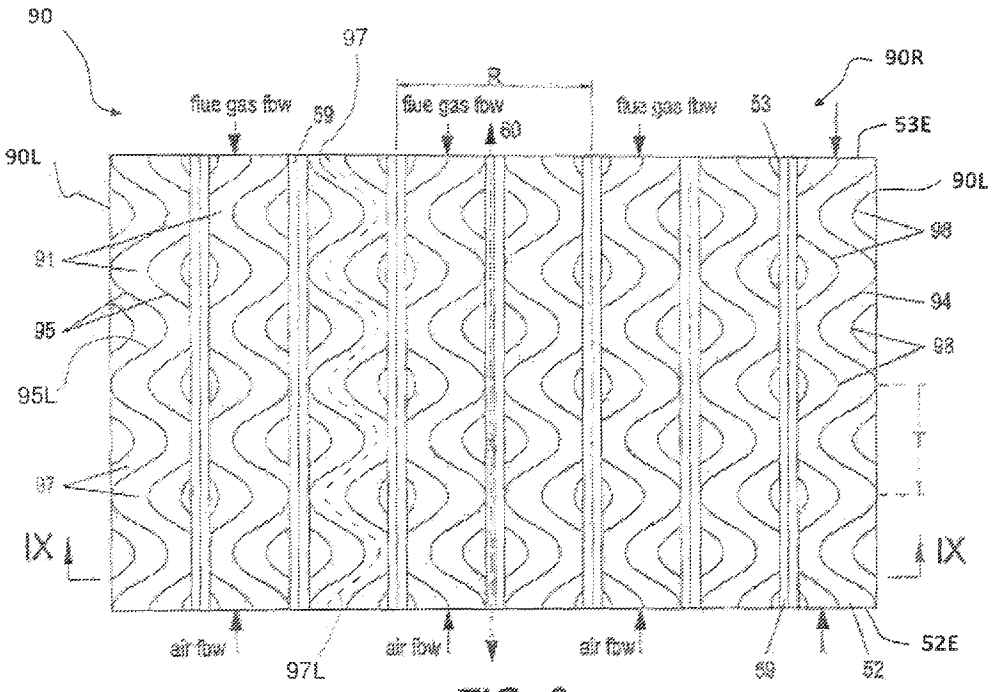
FIG. 8 is a plan view of another embodiment of a heat transfer sheet showing a sinusoidal ridge pattern according to the present invention.
Figure 9:
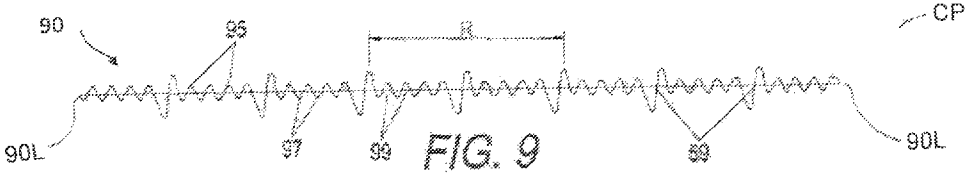
FIG. 9 is a cross sectional diagram of the heat transfer sheet of FIG. 8.

The heat transfer surface, otherwise known as "heating transfer sheet" is a key component in the air preheater. The heat transfer surface of a rotary regenerative heat exchanger, such as a Ljungstrom® air pre heater consists of thin profiled steel sheets, packed in frame baskets or assembled in bundles, and installed in the air preheater rotor. During each revolution of the rotor, the heat transfer sheet is passed alternately through the hot gas stream where it absorbs energy, and then through combustion air where they transfer the absorbed energy to the combustion air, preheating it. As shown in FIG. 7, the heat transfer sheet 50 is includes a substantially rectangular body 50R. The substantially rectangular body 50R is defined by a first longitudinal end 52 and a second longitudinal end 53 and lateral sides 50L that extend therebetween. The first longitudinal end 52 defines a first exposed edge surface 52E that extends entirely along the first longitudinal end 52. The second longitudinal end 53 defines a second exposed edge surface 53E that extends entirely along the second longitudinal end 53. As shown in FIG. 8, the heat transfer sheet 90 is includes a substantially rectangular body 90R having a central plane CP (FIG. 9). The substantially rectangular body 90R is defined by a first longitudinal end 52 and a second longitudinal end 53 and lateral sides 90L that extend therebetween. The central plane CP extends between the first longitudinal end 52 and the second longitudinal end 53 and the lateral sides 90L. The first longitudinal end 52 defines a first exposed edge surface 52E that extends entirely along the first longitudinal end 52. The second longitudinal end 53 defines a second exposed edge surface 53E that extends entirely along the second longitudinal end 53.

Figure 1:
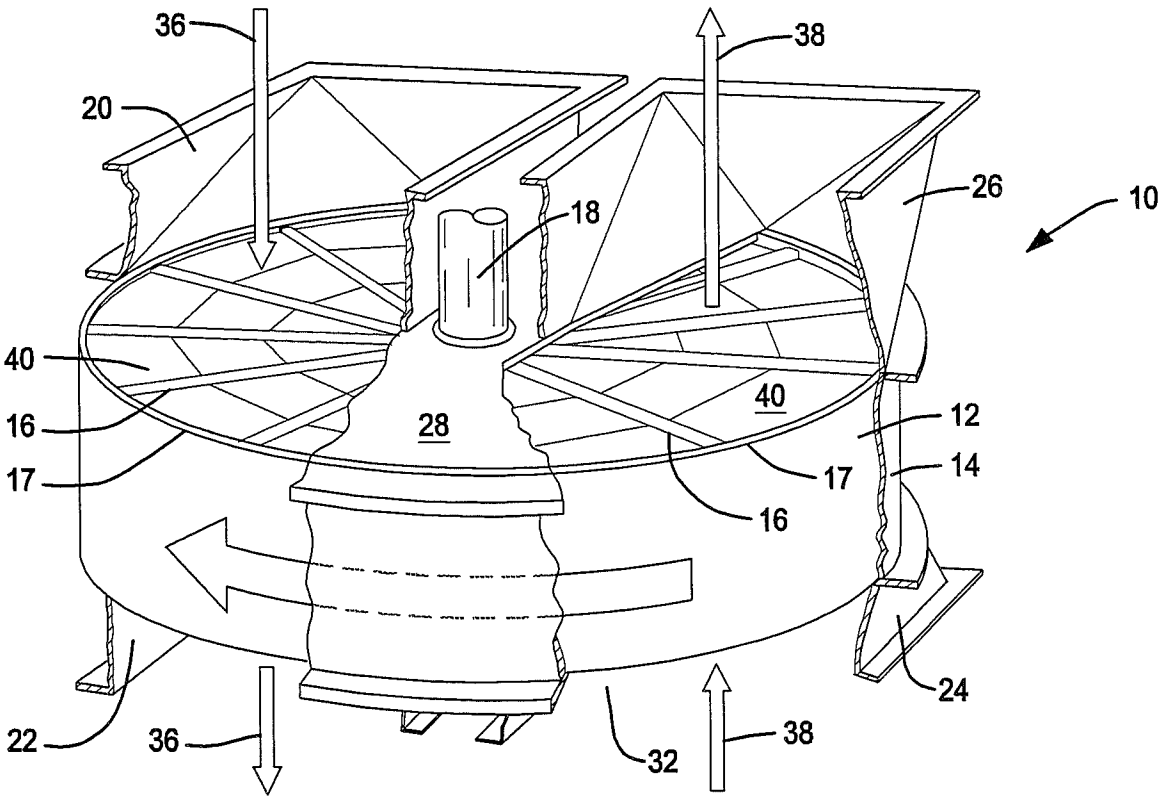
FIG. 1 Prior Art
FIG. 1 is a partially cut-away perspective view of a prior art rotary regenerative heat exchanger.

The housing 14 defines a flue gas inlet duct 20 and a flue gas outlet duct 22 for accommodating the flow of a heated flue gas stream 36 through the heat exchanger 10. The housing 14 further defines an air inlet duct 24 and an air outlet duct 26 to accommodate the flow of combustion air 38 through the heat exchanger 10. The rotor 12 has radial partitions 16 or diaphragms defining compartments 17 therebetween for supporting baskets (frames) 40 of heat transfer sheets 42. The heat exchanger 10 is divided into an air sector and a flue gas sector by sector plates 28, which extend across the housing 14 adjacent the upper and lower faces of the rotor 12. While FIG. 1 depicts a single air stream 38, multiple air streams may be accommodated, such as tri-sector and quad-sector configurations. These provide multiple preheated air streams that may be directed for different uses.

Figure 2:
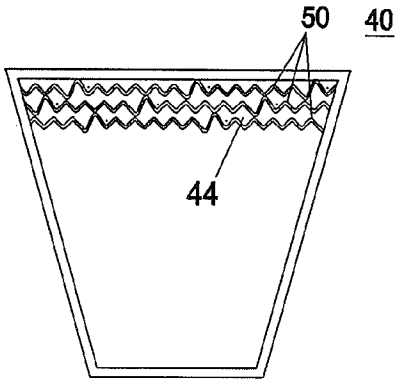
FIG. 2 Prior Art
FIG. 2 is a top plan view of a basket including three prior art heat transfer sheets.

As is shown in FIG. 2, one example of a sheet basket 40 includes a frame 41 into which heat sheets 50 are stacked. While only a limited number of heat sheets 50 are shown, it will be appreciated that the basket 40 will typically be filled with heat sheets 50. As also seen in FIG. 2, the heat sheets 50 are closely stacked in spaced relationship within the basket 40 to form passageways 44 between adjacent heat sheets 50. During operation, air or flue gas flows through these passageways 44.

Referring to both FIGS. 1 and 2, the heated flue gas stream 36 is directed through the gas sector of the heat exchanger 10 and transfers heat to the heat transfer sheets 50. The heat sheets 50 are then rotated about axis 18 to the air sector of the heat exchanger 10, where the combustion air 38 is directed over the heating sheets 50 and is thereby heated.

Figure 3:
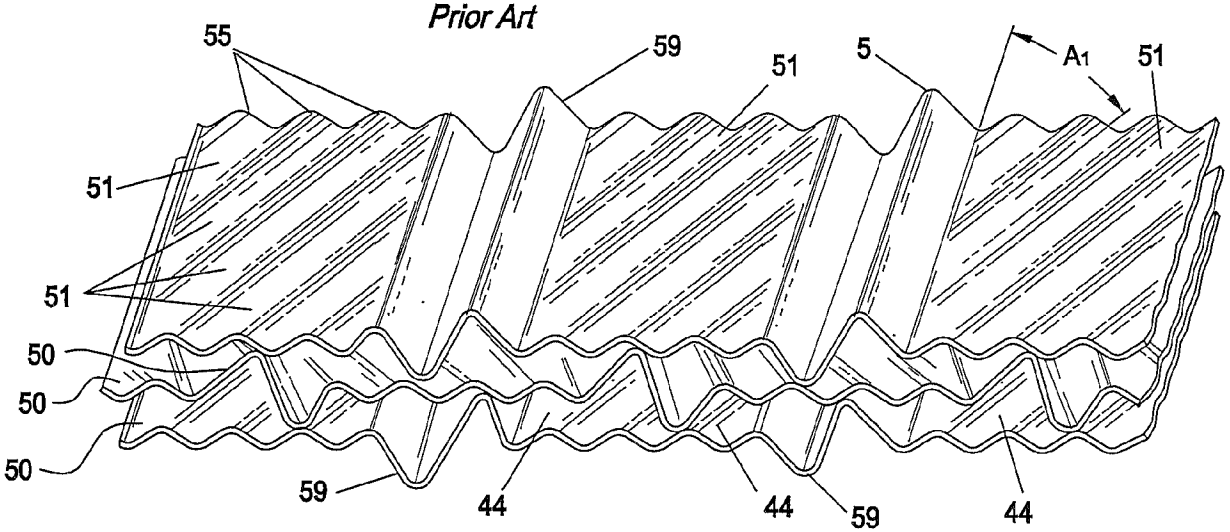
FIG. 3 Prior Art
FIG. 3 is a perspective view of a portion of three prior art heat transfer sheets shown in a stacked configuration.
Figure 4:
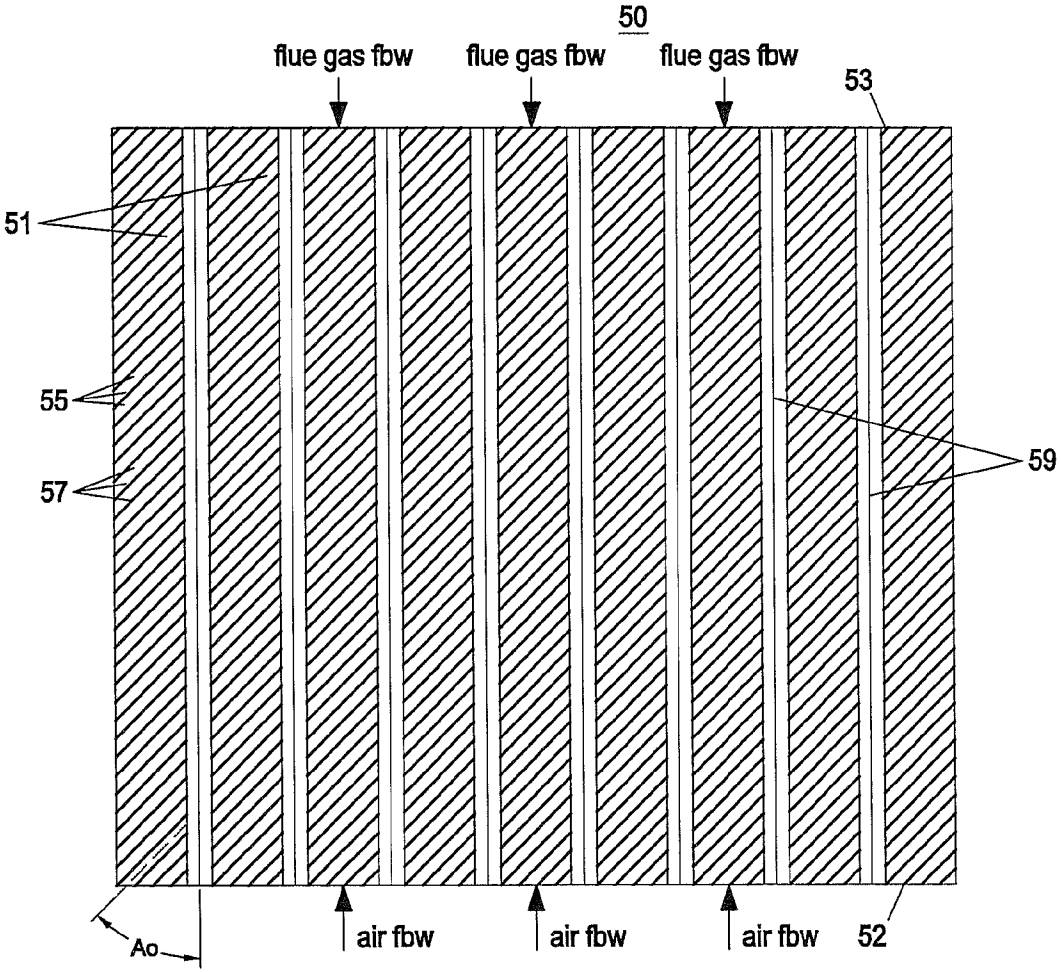
FIG. 4 Prior Art
FIG. 4 is a plan view of a prior art heat transfer sheet.

Referring to FIGS. 3 and 4, conventional heating sheets 50 are shown in a stacked relationship. Typically, heat sheets 50 are metal planar members that have been shaped to include one or more separation ribs 59 and undulations 51 defined in part by undulation ridges 55 and valleys 57.

The profiles of the heat transfer sheets 50 are critical to the performance of the air preheater and the boiler system. The geometrical design of the heat transfer sheet 50 profile focuses on three critical components; first, heat transfer, which directly relates to thermal energy recovery; second, pressure drop, affecting the boiler systems mechanical efficiency and third, the cleanability, allowing the preheater to operate at its optimum thermal and mechanical performance. The best performing heat transfer sheets provide high heat transfer rates, low pressure drop, and are easily cleaned.

The separation ribs 59 are positioned at generally equally spaced intervals and operate to maintain spacing between adjacent heat sheets 50 when stacked adjacent to one another and cooperate to form passageways 44 of FIGS. 2 and 3. These accommodate the flow of air or flue gas between the heat sheets 50.

As shown in FIG. 4, the separation ribs 59 extend parallel to the direction of air flow (e.g. 0 degrees) from a first end 52 of heat transfer sheet 50 to a second end 53 as then pass through the rotor (12 of FIG. 1).

The undulation ridges 55 in the prior art are arranged at the same angle A0 relative to the ribs 59 and, thus, the same angle relative to the flow of air indicated by the arrows marked "air flow". (Since the flue gases flow in the opposite direction as the air flow, the angles for flue gas flow will differ by 180 degrees.) The undulating ridges 55 act to direct the air near the surface in a direction parallel to the ridges 55 and valleys 57, initially causing turbulence. After a distance, the air flow begins to regulate and resemble laminar flow.

Figure 5:
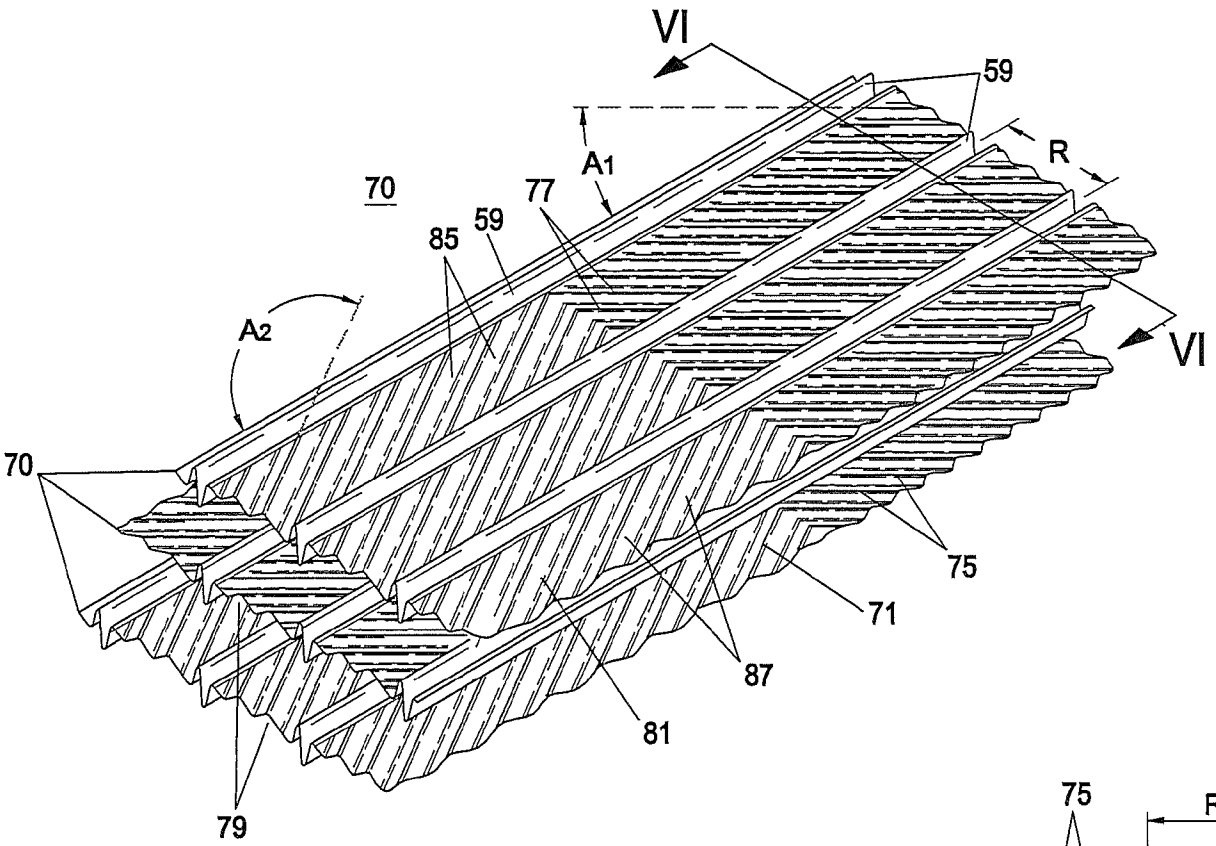
FIG. 5 is a perspective view of the portion of a heat transfer sheet according to one embodiment of the present invention.
Figure 6:
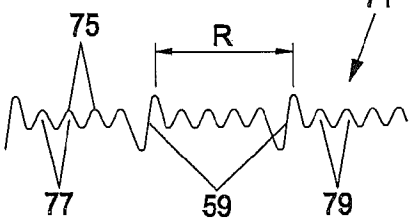
FIG. 6 is a cross-sectional view of the portion of the heat transfer sheet shown in FIG. 5.

Laminar flow means that layers of air are stratified and run parallel to each other. This indicates that the air near the surface will continue to be near the surface as it travels along a heat transfer sheet. Once the air near the surface reaches the temperature of the surface, there is little heat transfer between them. Any heat transfer for other layers must now pass through the layer near the surface, since they do not come in direct contact with the heat transfer sheet 50. Transfer of heat from laminar layer of air to an adjacent layer of air is not as efficient as heat transfer from air to the metal surface As is shown in FIGS. 5 to 7, undulating surface 71 has parallel undulations ridges 75 and valleys 77 make an acute first angle A1 with respect to separation ribs 59. Undulation surface 81 also has parallel ridges 85 and valleys 87 make an obtuse second angle A2 with respect to separation ribs 59. The repeated pattern is identified as "R". In this embodiment, as air passes along the surface, it is directed alternatively in opposite directions along the heat transfer sheet 70.

It is believed that the passageways between ridges 75, 85 of adjacent plates constantly redirect the flowing air first to the right, then left, then back right, etc. This constant redirection is believed to break up the laminar flow and cause more turbulence than the embodiment shown in FIG. 4. Therefore, different layers of air will now come in direct contact with the metal surface of the sheet 70. This is believed to increase heat transfer.

The angles shown in the figures are only for illustrative purposes. It is to be understood that the invention encompasses a wide variety of angles.

Even though only two undulation surfaces are shown here, it is understood that a number of undulation surfaces with different angles may also be added and fall under the scope of this invention.

There are sections in FIGS. 6 and 7 where the passageway is straight. One can further increase heat transfer by providing a design that has no straight sections and exhibits constant redirection to increase efficiency.

FIGS. 8 and 9 show another embodiment of a heat transfer sheet 90 having the first longitudinal end 52 and the second longitudinal end 53 and a longitudinal axis 60 extending from the first longitudinal end 52 to the second longitudinal end 53, according to the present invention. The first longitudinal end 52 and the second longitudinal end 53 are open across the heat transfer sheet 90 in a lateral direction (i.e., transverse or perpendicular to the longitudinal axis 60) for flow of fluid (e.g., flue gas flow and air flow) to and from the first longitudinal end 52 and the second longitudinal end 53. The heat transfer sheet 90 has at least one undulation surface 91. The heat transfer sheet 90 includes a plurality of sheet spacing features 59 extending along the rectangular metallic body 90R in the longitudinal direction 60 parallel to a direction of flow of the hot flue gas stream between the first longitudinal end 52 and the second longitudinal end 53. The sheet spacing features 59 extend away from opposing sides of the central plane CP. The sheet spacing features 59 define a portion of a flow passage between an adjacent heat transfer sheet 90. The undulation surface 91 has a plurality of ridges 95 and valleys 97 that extend normal to the rectangular body 90R into the flow passage. As viewed from above, the ridges 95 and valleys 97 have a sinusoidal shape or pattern 94 that undulate laterally between the lateral sides 90L. In one embodiment, the heat transfer sheet includes a plurality of sections of undulations 91 having a cross-section defined by ridges 95 and valleys 97 which undulate laterally. In a longitudinal direction 60 the undulations 91 are shaped in an at least a partial sinusoidal pattern. The at least partial sinusoidal pattern extends in the longitudinal direction 60 from the first longitudinal end 52 to a second longitudinal end 53 of the sheet so that at least one of the ridges 95 trace a continuous first line 95L, parallel to the central plane CP, from the first longitudinal end 52 to the second longitudinal end 53 and so that at least one of the valleys 97 trace a continuous second line 97L (shown as a dashed line in FIG. 8), parallel to the central plane CP, from the first longitudinal end 52 to the second longitudinal end 53. The at least partial sinusoidal pattern is oriented such that a fluid passing from the first longitudinal end 52 to the second longitudinal end 53 is at least partially and continuously redirected laterally in an alternating manner such that there are no straight through flow paths in the longitudinal direction, in the valleys, that extend continuously from said first longitudinal end to said second longitudinal end. In other words, the at least partial sinusoidal pattern is oriented such that the first line 95L and the second line 97L are at least partially and continuously redirected laterally in an alternating manner, such that no straight line extends continuously from said first longitudinal end 52 to said second longitudinal end 53 in the longitudinal direction 60 and in the valleys 97, without intersecting at least one of the undulation surfaces 91. Some sinusoidal patterns 94 complete one or more periods T. Sinusoidal patterns 94 on opposite sides of the separation ribs 59 are 180 degrees out of phase. Other phases and periods may be also be used and are within the scope of the present invention.

These ridges 95 and valleys 97 create sinusoidal passageways 99 when the heat transfer sheets 90 are placed against each other in the basket. The constant redirection of the air as it passes through the sinusoidal passageways 99 reduces laminar flow, thereby increasing turbulence and increasing heat transfer efficiency.

In some locations, only partial sinusoidal shapes 98 are formed. The sinusoidal patterns 94 are not limited to having a constant period T for all patterns 94 and having each section being 180 degrees out of phase with respect to the next section. The offset (phase angle) of the sinusoidal patterns may also differ from each other.

While the invention has been described with reference to exemplary embodiments, it will be understood by those skilled in the art that various changes may be made and equivalents may be substituted for heat transfer sheets thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A heat transfer sheet for a rotary regenerative heat exchanger that receives a hot flue gas stream and an air stream and transfers heat from the hot flue gas stream to the air stream, the heat transfer sheet comprising:

a rectangular metallic body having a central plane, the rectangular body being defined by and the central plane extending between a first longitudinal end and a second longitudinal end and lateral sides extending therebetween, the first longitudinal end defining a first exposed edge surface entirely along the first longitudinal end and the second longitudinal end defining a second exposed edge surface entirely along the second longitudinal end;

a plurality of sheet spacing features extending along the rectangular metallic body in a longitudinal direction parallel to a direction of flow of the hot flue gas stream between the first longitudinal end and the second longitudinal end, the sheet spacing features extending away from opposing sides of the central plane, and the sheet spacing features defining a portion of a flow passage between an adjacent heat transfer sheet; and a plurality of sections of undulations disposed between each pair of adjacent sheet spacing features, the plurality of sections of undulations having a cross-section defined by ridges and valleys that extend normal to the rectangular metallic body into the flow passage, the plurality of sections of undulations undulate laterally between the lateral sides, in the longitudinal direction and parallel to the central plane said plurality of sections of undulations are shaped in an at least partial sinusoidal pattern, said at least partial sinusoidal pattern extending in the longitudinal direction from said first longitudinal end to said second longitudinal end of the sheet so that at least one of the ridges trace a continuous first line, parallel to the central plane, from said first longitudinal end to said second longitudinal end and so that at least one of the valleys trace a continuous second line, parallel to the central plane, from said first longitudinal end to said second longitudinal end, said first longitudinal end and said second longitudinal end being exposed across the entire sheet in a direction transverse to the longitudinal direction to allow a fluid to flow therethrough, said at least partial sinusoidal pattern being oriented such that the first line and the second line are at least partially and continuously redirected laterally in an alternating manner, such that there are no straight through flow paths in the longitudinal direction, in the valleys, that extend continuously from said first longitudinal end to said second longitudinal end.

2. The heat transfer sheet of claim 1 wherein the sinusoidal pattern is comprised of several periods, T.

3. The heat transfer sheet of claim 1 wherein at least a portion of ridges trace out less than a full sinusoidal period, T.

4. The heat transfer sheet of claim 1 wherein there are at least two sinusoidal patterns that are out of phase with respect to each other.

5. The heat transfer sheet of claim 4 wherein the at least two sinusoidal patterns are a full period T out of phase.

6. The heat transfer sheet of claim 1 wherein passageways are created under the ridges formed in an undulation surface of a heat transfer sheet when placed against another undulation surface of another heat transfer sheet.

7. A basket for a rotary regenerative heat exchanger, the basket comprising:

a frame; and at least one heat transfer sheet that receives a hot flue gas stream and an air stream and transfers heat from the hot flue gas stream to the air stream, the heat transfer sheet comprising:

a rectangular metallic body having a central plane, the rectangular body being defined by and the central plane extending between a first longitudinal end and a second longitudinal end and lateral sides extending therebetween, the first longitudinal end defining a first exposed edge surface entirely along the first longitudinal end and the second longitudinal end defining a second exposed edge surface entirely along the second longitudinal end;

a plurality of sheet spacing features extending along the rectangular metallic body in a longitudinal direction parallel to a direction of flow of the hot flue gas stream between the first longitudinal end and the second longitudinal end, the sheet spacing features extending away from opposing sides of the central plane, and the sheet spacing features defining a portion of a flow passage between an adjacent heat transfer sheet; and a plurality of sections of undulations disposed between each pair of adjacent sheet spacing features, the plurality of sections of undulations having a cross-section defined by ridges and valleys that extend normal to the rectangular metallic body into the flow passage, the plurality of sections of undulations extend laterally between the lateral sides, in the longitudinal direction and parallel to the central plane, said plurality of sections of undulations are shaped in an at least partial sinusoidal pattern, said at least partial sinusoidal pattern extending in the longitudinal direction from said first longitudinal end to said second longitudinal end of the sheet so that at least one of the ridges trace a continuous first line, parallel to the central plane, from said first longitudinal end to said second longitudinal end and so that at least one of the valleys trace a continuous second line, parallel to the central plane, from said first longitudinal end to said second longitudinal end, said first longitudinal end and said second longitudinal end being exposed across the entire sheet in a direction transverse to the longitudinal direction to allow a fluid to flow therethrough, said at least partial sinusoidal pattern being oriented such that the first line and the second line are at least partially and continuously redirected laterally in an alternating manner, such that there are no straight through flow paths in the longitudinal direction, in the valleys, that extend continuously from said first longitudinal end to said second longitudinal end.

8. The basket of claim 7 wherein the sinusoidal pattern of the heat transfer sheet comprises several periods, T.

9. The basket of claim 7 wherein the sinusoidal pattern of the heat transfer sheet comprises less than a full sinusoidal period, T.

10. The basket of claim 7 wherein the heat transfer sheet has several sinusoidal patterns that are out of phase with respect to each other.

11. The heat transfer sheet of claim 4 wherein at least one sinusoidal pattern has a period T that is different from that of at least one other sinusoidal pattern.

12. The basket of claim 7 wherein the heat transfer sheet has at least two sinusoidal patterns having a different sinusoidal period T.

13. The basket of claim 12 wherein there are at least two sinusoidal patterns that are out of phase with respect to each other.

* * * * *